US006450778B1

(12) United States Patent
Spoolstra et al.

(10) Patent No.: US 6,450,778 B1
(45) Date of Patent: Sep. 17, 2002

(54) PUMP SYSTEM WITH HIGH PRESSURE RESTRICTION

(75) Inventors: Gregg R. Spoolstra, Byron Center, MI (US); Robert D. Straub, Lowell, MI (US)

(73) Assignee: Diesel Technology Company, Kentwood, MI (US)

( * ) Notice: Subject to any disclaimer, the term of this patent is extended or adjusted under 35 U.S.C. 154(b) by 0 days.

(21) Appl. No.: 09/731,462

(22) Filed: Dec. 7, 2000

(51) Int. Cl.[7] ..... F04B 49/00

(52) U.S. Cl. ..... 417/307; 417/283; 417/289; 123/506; 123/458

(58) Field of Search ..... 123/496, 506, 123/500, 501, 502, 357, 458; 417/307, 304, 283, 288, 289

(56) References Cited

U.S. PATENT DOCUMENTS

| | | | | |
|---|---|---|---|---|
| 2,019,650 A | | 11/1935 | Bischof | |
| 2,022,643 A | | 11/1935 | Hueber et al. | |
| 2,190,464 A | | 2/1940 | Wile | |
| 2,770,394 A | | 11/1956 | Mueller | |
| 3,556,464 A | | 1/1971 | Griswold | |
| 3,779,225 A | | 12/1973 | Watson et al. | |
| 3,810,485 A | | 5/1974 | Gawlick et al. | |
| 3,958,902 A | | 5/1976 | Toyoda et al. | |
| 4,161,161 A | | 7/1979 | Bastenhof | |
| 4,174,693 A | | 11/1979 | Steinwart et al. | |
| 4,214,565 A | | 7/1980 | Knapp et al. | |
| 4,269,361 A | | 5/1981 | Seilly | |
| 4,303,096 A | | 12/1981 | Skinner | |
| 4,417,693 A | | 11/1983 | Fussner et al. | |
| 4,445,484 A | | 5/1984 | Marion | |
| 4,474,158 A | * | 10/1984 | Mowbray | 123/458 |
| 4,485,843 A | | 12/1984 | Wolff | |
| 4,501,244 A | * | 2/1985 | Jarrett et al. | 123/446 |
| 4,501,246 A | | 2/1985 | Leblanc | |
| 4,510,908 A | * | 4/1985 | Eisele et al. | 123/449 |
| 4,569,641 A | | 2/1986 | Falk et al. | |
| 4,618,095 A | | 10/1986 | Spoolstra | |
| 4,619,239 A | | 10/1986 | Wallenfang et al. | |
| 4,627,571 A | | 12/1986 | Kato et al. | |
| 4,628,727 A | | 12/1986 | Seaman et al. | |

(List continued on next page.)

FOREIGN PATENT DOCUMENTS

| | | |
|---|---|---|
| DE | 199 08 102 C1 | 5/2000 |
| EP | 0 803 648 A1 | 4/1997 |
| EP | 0 823 549 A2 | 8/1997 |
| WO | WO 97/01031 | 1/1997 |

OTHER PUBLICATIONS

D.R. Coldren and M.E. Moncelle; Advanced Technology Fuel System For Heavy Duty Diesel Engines; SAE Technical Paper Series 973182.

*Primary Examiner*—Charles G. Freay
*Assistant Examiner*—Han L. Liu
(74) *Attorney, Agent, or Firm*—Brooks & Kushman P.C.

(57) ABSTRACT

A pumping system for a fuel injection system includes a body defining a high pressure pumping chamber, a plunger, a high pressure outlet, a high pressure fluid line connecting the pumping chamber to the outlet, a control valve along the fluid line, and a valve and restriction arrangement along the fluid line. The valve and restriction arrangement includes a restriction and a valve body. The valve body is movable between an open position in which fuel flow from the pumping chamber is generally unrestricted by the restriction and a closed position in which fuel flow from the pumping chamber is significantly restricted by the restriction to store energy in the pumping chamber. Advantageously, the high pressure restriction concept may be utilized in a pumping system for various types of rate shaping, including boot injection and square injection, in addition to pilot operation and post injection operations, and others.

16 Claims, 10 Drawing Sheets

U.S. PATENT DOCUMENTS 4,711,216 A * 12/1987 Takeuchi ..... 123/447
4,730,585 A 3/1988 Abe et al.
4,747,545 A 5/1988 Trachte et al.
4,782,807 A 11/1988 Takahashi
4,784,101 A 11/1988 Iwanaga et al.
4,829,967 A 5/1989 Nuti
4,889,288 A 12/1989 Gaskell
4,911,366 A 3/1990 Priesner
4,917,065 A 4/1990 Law et al.
4,957,275 A 9/1990 Homes
4,979,674 A 12/1990 Taira et al.
4,986,728 A 1/1991 Fuchs
5,025,768 A 6/1991 Eckert
5,062,449 A 11/1991 Woollums et al.
5,076,239 A * 12/1991 Mina ..... 123/496
5,118,076 A 6/1992 Homes
5,125,807 A 6/1992 Kohler et al.
5,241,935 A 9/1993 Beck et al.
5,333,588 A * 8/1994 Cananagh
5,341,783 A 8/1994 Beck et al.
5,345,916 A 9/1994 Amann et al.
5,373,828 A 12/1994 Askew et al.
5,385,455 A 1/1995 Dinsmore et al.
5,423,484 A 6/1995 Zuo
5,425,341 A 6/1995 Connolly et al.
5,427,352 A 6/1995 Brehm
5,464,334 A 11/1995 Cook et al.
5,494,219 A 2/1996 Maley et al.
5,517,972 A * 5/1996 Stockner ..... 123/496
5,524,826 A 6/1996 Mueller et al.
5,553,481 A 7/1996 Kronberger
5,562,428 A 10/1996 Bailey et al.
5,566,660 A 10/1996 Camplin et al.
5,605,289 A 2/1997 Maley et al.
5,606,953 A * 3/1997 Drummer et al. ..... 123/506
5,619,969 A * 4/1997 Liu et al. ..... 123/447
5,632,444 A 5/1997 Camplin et al.
5,647,536 A 7/1997 Yen et al.
5,651,345 A 7/1997 Miller et al.
5,651,501 A 7/1997 Maley et al.
5,662,087 A 9/1997 McCandless
5,669,356 A 9/1997 Wall et al.
5,673,853 A 10/1997 Crofts et al.
5,685,490 A 11/1997 Ausman et al.
5,694,903 A 12/1997 Ganser
5,706,778 A 1/1998 Kapus
5,709,341 A 1/1998 Graves
5,711,277 A 1/1998 Fuseya
5,727,738 A 3/1998 Hofmann et al.
5,730,104 A 3/1998 Hafner
5,730,261 A 3/1998 Spakowski et al.
5,738,075 A 4/1998 Chen et al.
5,749,717 A 5/1998 Straub et al.
5,752,659 A 5/1998 Moncelle
5,765,755 A 6/1998 Peters et al.
5,769,319 A 6/1998 Yen et al.
5,803,370 A 9/1998 Heinz et al.
5,860,597 A 1/1999 Tarr
5,868,317 A 2/1999 English
5,884,848 A 3/1999 Crofts et al.
5,887,790 A 3/1999 Flinn
5,894,992 A 4/1999 Liu et al.
5,913,300 A * 6/1999 Drummond ..... 123/467
5,954,487 A 9/1999 Straub et al.
5,967,413 A 10/1999 Tian
5,976,413 A 11/1999 Diaz et al.
6,012,644 A 1/2000 Sturman et al.
6,019,091 A 2/2000 Spoolstra
6,019,344 A 2/2000 Engel et al.
6,053,421 A 4/2000 Chockley
6,059,545 A 5/2000 Straub et al.
6,085,726 A * 7/2000 Lei et al. ..... 123/446
6,213,093 B1 * 4/2001 Yudanov et al. ..... 123/446

* cited by examiner 178
180
170
176
174
172
190
196
188
194
184
182
186
192
208
206
202
200
210
212
204
214
216
216

PUMP SYSTEM WITH HIGH PRESSURE RESTRICTION

TECHNICAL FIELD

This invention relates to pump systems for fuel injection systems.

BACKGROUND ART

Engine exhaust emission regulations are becoming increasingly restrictive. One way to meet emission standards is to precisely control the quantity and timing of the fuel injected into the combustion chamber to match the engine cycle. For certain engine operating conditions, effective injection rate shaping may result in reduced levels of particulates and oxides of nitrogen in the engine exhaust. One form of effective rate shaping injects fuel slower during the early phase of the combustion process, resulting in less engine noise.

Existing rate shaping techniques attempt to control injection rates by making various modifications to the injector nozzle assembly. Although these existing rate shaping techniques have been employed in many applications that have been commercially successful, there is a need for a rate shaping technique that allows more precise rate shaping than the existing modified injector nozzle assemblies.

DISCLOSURE OF INVENTION

It is, therefore, an object of the present invention to provide a pump system utilizing a high pressure restriction to precisely control quantity and timing of fuel injected into the combustion chamber of an internal combustion engine.

In carrying out the above object, a pump system for a fuel injection system is provided. The pump system comprises a body defining a high pressure pumping chamber, a plunger disposed in the pumping chamber for pressurizing fuel, a high pressure outlet, and a high pressure fluid line connecting the pumping chamber to the outlet. The system further comprises a control valve along the fluid line, and a valve and restriction arrangement along the fluid line. The control valve includes a first valve body movable between a closed position and an open position. In the closed position, pressurized fuel is routed from the pumping chamber to the outlet. In the open position, pressure relief is provided to the fluid line. The valve and restriction arrangement includes a restriction and a second valve body. The second valve body is movable between an open position and a closed position. In the open position, fuel flow from the pumping chamber is generally unrestricted by the restriction. In the closed position, fuel flow from the pumping chamber is significantly restricted by the restriction to store energy in the pumping chamber.

The pump system of the present invention advantageously utilizes a high pressure restriction to affect control over the quantity and timing of the fuel injected into the combustion chamber. In one embodiment, the body is a unit pump body, and the high pressure outlet is configured for flow communication with a fuel injector. In another embodiment, the body is a unit injector body and defines a needle chamber. An injector nozzle assembly is in flow communication with the high pressure outlet. The injector nozzle assembly includes a needle received in the needle chamber. The needle chamber receives pressurized fuel from the pump outlet. That is, embodiments of the present invention are suitable for use in both unit pumps and unit injectors.

In some embodiments, the second valve body is configured as a pressure-balance valve. In a particular application, the second valve body open position provides a flow cross-sectional area, not including any effective flow cross-sectional area of the restriction, of about two to three millimeters squared. In some embodiments, the second valve body is configured as a pressure-balanced spool valve, and utilizes a through passage as the restriction.

Depending on the particular type of control over fuel injection quantity and timing that is desired, the valve and restriction arrangement may be located between the pumping chamber and the control valve, or alternatively, the valve and restriction arrangement may be located between the control valve and the outlet. For example, a valve and restriction arrangement of the present invention between the pumping chamber and the control valve allows effective control for pilot injection, boot injection, square injection, and post injection. On the other hand, a valve and restriction arrangement located between the control valve and the outlet allows effective control over pilot operations and boot injection.

Further, in carrying out the present invention, a method of controlling a pump system for a fuel injection system is provided. The pump system has a body defining a high pressure pumping chamber, a plunger disposed in the pumping chamber for pressurizing fuel, a high pressure outlet, and a high pressure fluid line connecting the pumping chamber to the outlet. A control valve along the fluid line includes a first valve body movable between a closed position and an open position. In the closed position, pressurized fuel is routed from the pumping chamber to the outlet. In the open position, pressure relief is provided to the fluid line. The method comprises controlling a valve and restriction arrangement along the fluid line. The valve and restriction arrangement includes a restriction and a second valve body. The second valve body is movable between an open position and a closed position. In the open position, fuel flow from the pumping chamber is generally unrestricted by the restriction. In the closed position, fuel flow from the pumping chamber is significantly restricted by the restriction to store energy in the pumping chamber. The valve and restriction arrangement is controlled so as to control fuel flow from the pumping chamber to the outlet.

Advantageously, the method may be utilized to affect various types of control over the quantity and timing of the fuel injected into the combustion chamber. In an embodiment of the invention that reduces the rate of injection, the method further comprises closing the control valve for an injection by moving the first valve body to the closed position, and restricting fuel flow from the pumping chamber by moving the second valve body to the closed position to reduce an injection rate, while the control valve is closed. For a pilot injection, the method further comprises closing the control valve, restricting fuel flow from the pumping chamber while the control valve is closed, and thereafter, opening the control valve by moving the first valve body to the open position, ending the reduced rate pilot injection.

In a boot injection, the method further comprises closing the control valve for injection by moving the first valve body to the closed position, and restricting fuel flow from the pumping chamber by moving the second valve body to the closed position to reduce an injection rate and store energy in the pumping chamber, while the control valve is closed. Further, for a boot injection, the method further comprises unrestricting fuel flow from the pumping chamber by moving the second valve body to the open position to increase the injection rate, while the control valve is closed, and thereafter, opening the control valve by moving the first valve body to the open position, ending the boot injection.

For square injection, the valve and restriction arrangement is located between the pumping chamber and the control valve, and the method further comprises opening the control valve by moving the first valve body to the open position, restricting fuel flow from the pumping chamber by moving the second valve body to the closed position to store energy in the pumping chamber, while the control valve is open. The method further comprises, thereafter, closing the control valve by moving the first valve body to the closed position, and unrestricting fuel flow from the pumping chamber by moving the second valve body to the open position to increase the injection rate, while the control valve is closed.

For reducing plunger noise, the valve and restriction arrangement is located between the pumping chamber and the control valve and the method further comprises closing the control valve by moving the first valve to the closed position, and unrestricting fuel flow from the pumping chamber by moving the second valve body to the open position, while the control valve is closed. The method further comprises, thereafter, opening the control valve by moving the first valve body to the open position, and restricting fuel flow from the pumping chamber by moving the second valve body to the closed position to reduce pressure release at the plunger, while the control valve is open.

For post injection, in addition to reducing the rate of pressure release at the plunger, the method further comprises, closing the control valve by moving the first valve body to the closed position. Further, thereafter, fuel flow may be unrestricted from the pumping chamber by moving the second valve body to the open position to increase an injection rate for post injection, while the control valve is closed.

The advantages associated with embodiments of the present invention are numerous. For example, pumping systems such as unit pumps or unit injectors made in accordance with the present invention utilize a high pressure restriction to allow more precise control over the quantity and timing of injection into the combustion chamber. Embodiments of the present invention allow sophisticated control over the quantity and timing of injection and may be utilized to perform, for example, pilot operation, rate shaping including boot injection or square injection, and post injection, in addition to reducing the rate of pressure release at the plunger after an injection, to reduce noise.

Further, it is appreciated that the valve and restriction arrangement may be located between the control valve and the plunger chamber or alternatively between the control valve and the outlet depending on the particular control techniques to be performed. Boot injection may be utilized to reduce oxides of nitrogen, while square injection may be utilized during high exhaust gas recirculation rates to reduce particulates. Further, embodiments of the present invention may be utilized to perform multiple injections into the combustion chamber during a single cycle.

The above object and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
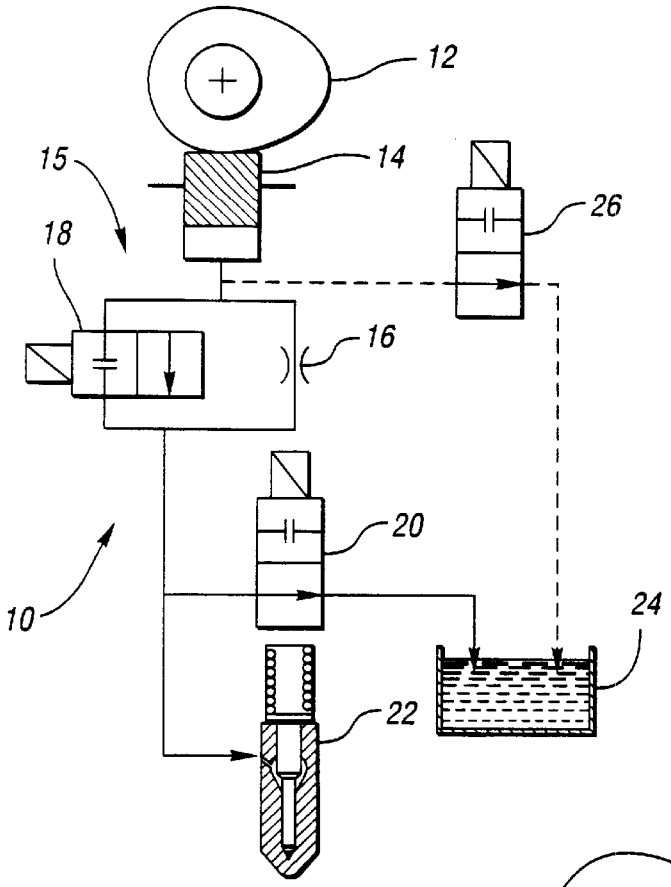
FIG. 1 is a schematic diagram of a first embodiment of the present invention.
Figure 3:
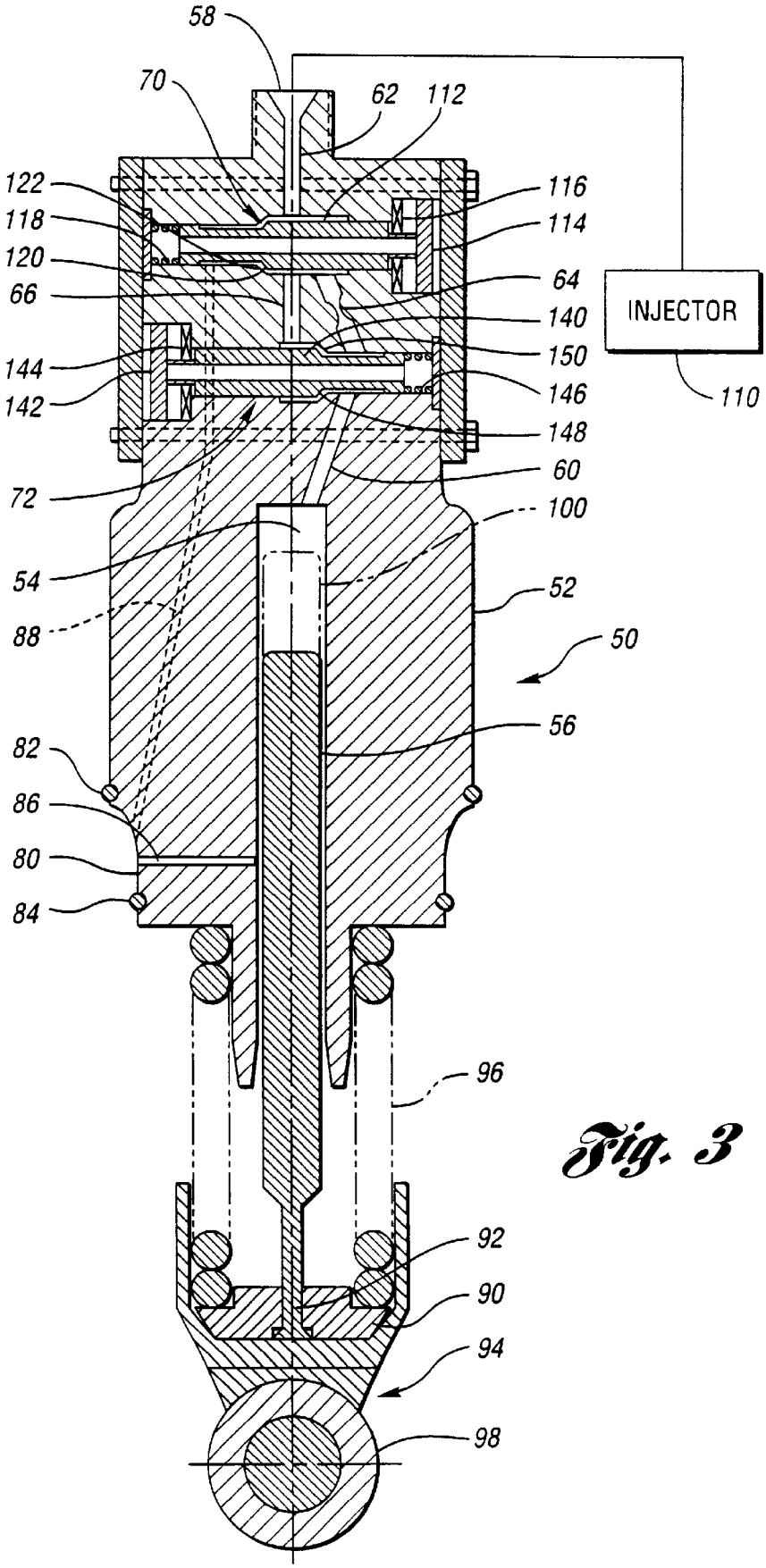
FIG. 3 is a side elevation, in section, of a unit pump of the present invention.
Figure 4:
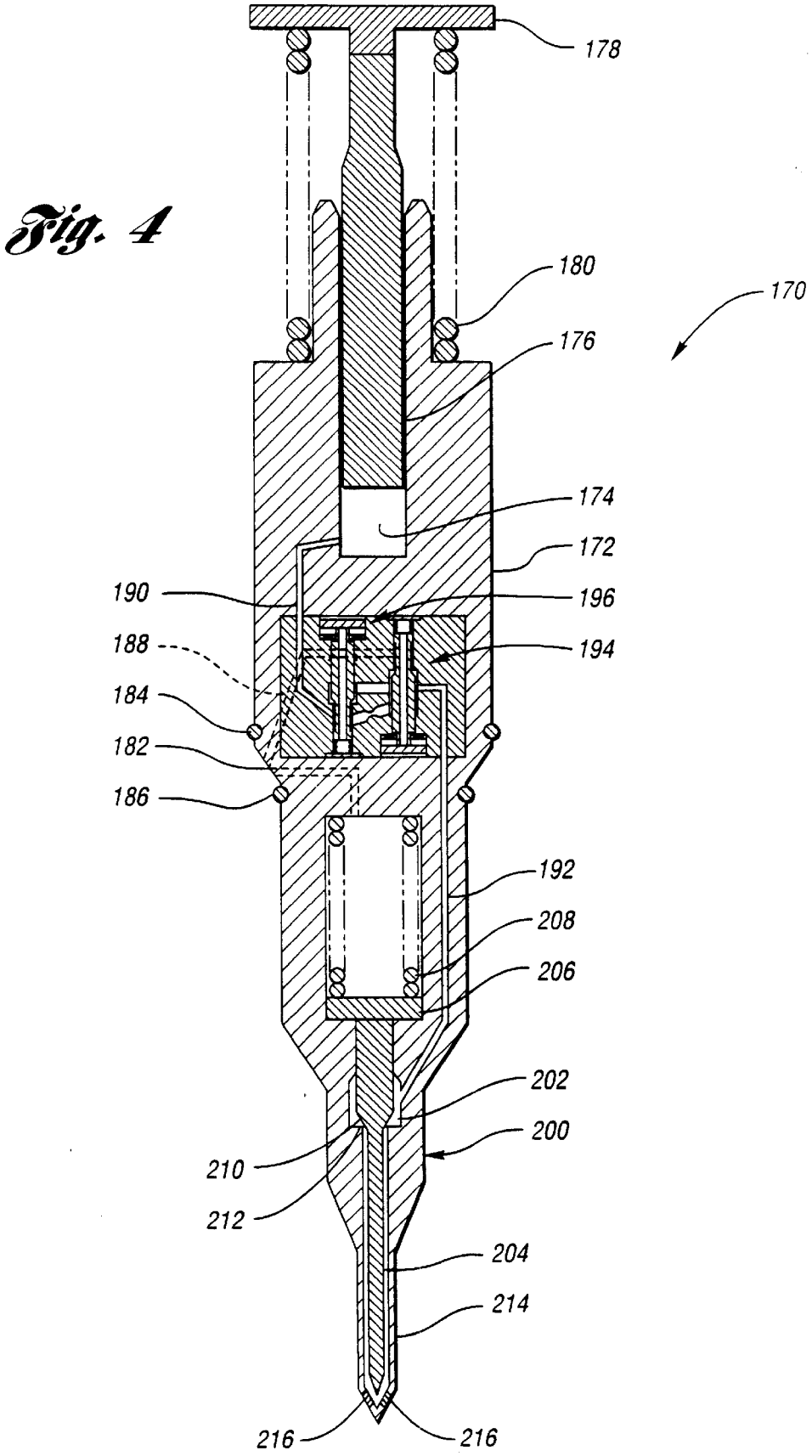
FIG. 4 is a side elevation, in section, of a unit injector of the present invention.

A pump system for a fuel injection system is generally indicated at 10, in FIG. 1. An engine driven cam 12 drives a plunger 14. The pumping chamber of plunger 14 is connected to an injector via a high pressure fluid line. In embodiments of the present invention, the pump system may be a unit pump connected via a high pressure fluid line to an injector, or alternatively, may be a unit injector. Further, it is appreciated that embodiments of the present invention are broadly illustrated in FIGS. 1 and 2, and that the exemplary implementations in FIGS. 3 and 4 are included for illustration purposes. That is, there are many different ways to implement embodiments of the present invention in accordance with the schematic illustrations in FIGS. 1 and 2. With continuing reference to FIG. 1, a valve and restriction arrangement is generally indicated at 15, and includes high pressure restriction 16 and valve 18. As shown, the valve body is movable between a closed position that causes fuel flow through the high pressure fluid line to be significantly restricted by restriction 16 to store energy in the pumping chamber at plunger 14. In the open position, restriction 16 generally does not restrict fluid flow through the high pressure line, as fluid flow may pass through valve 18. It is appreciated that significantly restricted by restriction 16 means that there is a noticeable pressure difference between the pumping chamber and the other side of the restriction (the unit pump outlet or the unit injector needle chamber). That is, significantly restricted means restricted sufficiently to reduce the rate of injection for a boot injection, or reduced rate pilot injection, etc. Further, generally unrestricted (when valve 18 is open) means that flow through restriction 16 is minimal and injection events may occur normally.

With continuing reference to FIG. 1, the control valve 20 is closed to route pressurized fuel from the pumping chamber to the pumping system outlet, which in turn, connects to injector 22. When control valve 20 is open, fuel flow from the pumping chamber bypasses the pump system outlet to low pressure reservoir 24. It is appreciated that the control valve is preferably positioned between the valve and restriction arrangement 15 and the pump system outlet. Alternatively, a control valve 26 may be located between the valve and restriction arrangement and pumping chamber. It is appreciated that the alternative arrangement may be utilized for boot injection, while the preferred arrangement may be utilized for boot injection and square injection. Further, it is appreciated that embodiments of the present invention are not limited to any particular injection control strategies, however, embodiments of the present invention are particularly useful for reduced rate pilot injection, rate shaping including boot injection, square injection, and post injection, in addition to reducing plunger noise after injection.

Figure 2:
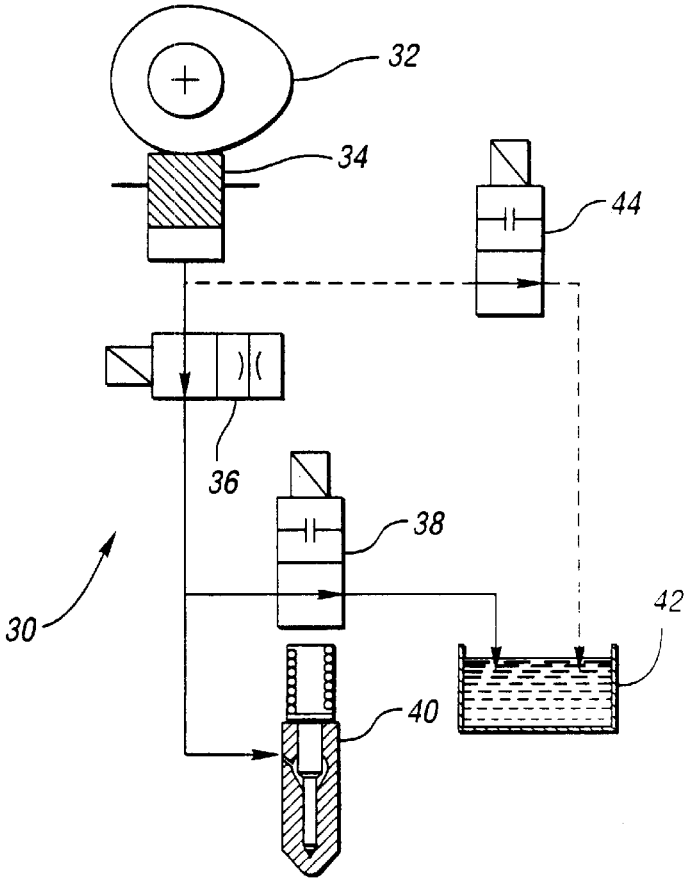
FIG. 2 is a schematic diagram of a second embodiment of the present invention.

Another embodiment of the present invention is illustrated in FIG. 2. An engine driven cam 32 drives plunger 34 to pressurize fuel in a pumping chamber. The valve and restriction arrangement 36 utilizes a high pressure restriction as part of the valve. This is different than FIG. 1, in which the high pressure restriction may be separate from the valve. The control valve is indicated at 38, with the injector indicated at 40. Pumping system 30 of FIG. 2 may alternatively utilize control valve 44 in a similar fashion as the embodiment of FIG. 1. Further, low pressure fuel reservoir 42 receives fuel that bypasses injector 40 through control valve 38 when control valve 38 is open.

In FIG. 3, a unit pump in an exemplary implementation of the invention is generally indicated at 50. Pump 50 includes a pump body 52 defining high pressure pumping chamber 54. A plunger 56 is disposed in the pumping chamber for pressurizing fuel. A high pressure outlet 58 connects to an injector 110 through a high pressure line, optionally including a check valve. A high pressure outlet is connected to the pumping chamber by the high pressure fluid line. In the unit pump embodiment, the high pressure fluid line includes passage 60 and passage 62. Passage 64 is a high pressure restriction, while passage 66 is a bypass for the restriction. Control valve 70 selectively routes pressurized fuel from the pumping chamber 54 to the outlet 58 or when open, provides pressure relief to the pumping chamber through relief passage 88. Valve and restriction arrangement 72 selectively directs fuel through restriction 64 or, when open, allows fuel to effectively bypass high pressure restriction 64 through passage 66. Fuel annulus 80 allows fuel to be drawn into the pumping chamber 54 through passage 88 when both valves are open. O-rings 82 and 84 seal off inlet 80. Passage 86 allows any leakage past plunger 56 to return to the low pressure fuel source (not shown) connected to inlet 80.

Plunger 56 has a tail end 92 received in plunger seat 90. A plunger spring 96 biases the plunger to the retracted position. The plunger may be driven to the extended position by an engine driven cam (not shown). A cam follower assembly 94 receives the plunger seat and has a cam roller 98 that is driven by a cam to urge the plunger to the extended position, compressing fuel in the pumping chamber. As the plunger is continuously driven from the retracted to the extended position, the valves 70 and 72 are controlled to selectively supply fuel at various pressures to outlet 58, and to injector 110. The extended position of the plunger is shown in phantom at 100.

With continuing reference to FIG. 3, control valve 70 includes a valve body 112 secured to an armature 114. Solenoid 116 is energized to close the valve by pulling armature 114 towards solenoid 116. As shown, the valve is open. When closed, seating surface 120 is urged into closing contact with valve seat 122. A spring 118 biases the control valve toward the open position. Valve 72 operates in a similar fashion, and includes valve body 140 secured to armature 142. A solenoid 144 is energized to pull armature 142 towards solenoid 144 and close the valve. The valve 72 is shown in the open position. When closed, valve seating surface 148 is pulled into closing contact with seating surface 150. Spring 146 biases control valve 72 toward the open position. When valve 72 is closed, pressurized fuel from pumping chamber 54 is significantly restricted by restriction 64 to create a pressure differential between pumping chamber 54 and outlet 62. When valve 72 is opened, flow from pumping chamber 54 is generally unrestricted, and fuel may flow through passage 66. Similarly, when valve 70 is closed, pressurized fuel may be routed from chamber 54 to outlet 62, with the pressure at outlet 62 possibly being reduced while valve 72 is closed. When valve 70 is open, the fuel flow from the pumping chamber may pass valve seating surface 120 and return through passage 88 to the low pressure inlet 80.

It is appreciated that embodiments shown in FIG. 3 operates similar to the schematic shown in FIG. 1, but may alternatively be arranged to operate more similar to the schematic of FIG. 2. Alternatively, valve 72 of the valve and restriction arrangement may be replaced with a normally closed solenoid poppet type valve or other suitable valve as appreciated by one of ordinary skill in the art. Some flexibility is comprised by utilizing a poppet valve, but such a solution may provide a cost-effective solution for rate shape and higher initial injection rate implementations. Specifically, the poppet valve would not be able to reclose for post injection.

In FIG. 4, a unit injector exemplary implementation is generally indicated at 170. Unit injector 170 includes an injector body 172 that defines a pumping chamber 174. A plunger 176 is driven by a cam that drives against plunger holder and spring seat 178. Spring 180 biases the plunger to the retracted position.

An inlet 182 supplies low pressure fuel to the unit injector. O-rings 184 and 186 effectively seal fuel inlet when the unit injector is received in the engine block. Passage 188 connects inlet 182 to the control valve and valve and restriction arrangement. The valve and restriction arrangement is generally indicated at 196 while the control valve is generally indicated at 194. The valves operate similar to the valves in the unit pump shown in FIG. 3. The output of the pumping system is passage 192, which passes pressurized fuel to the injector nozzle assembly 200. Lower or needle chamber 202 receives pressurized fuel at a pressure controlled by controlling valves 194 and 196 as plunger 176 is reciprocated. Sufficient pressure in chamber 202 causes needle seating surface 210 of needle 204 to lift off of needle seat 212, allowing fuel to flow through passage 214 and out the end of the injector through holes 216.

Figure 20:
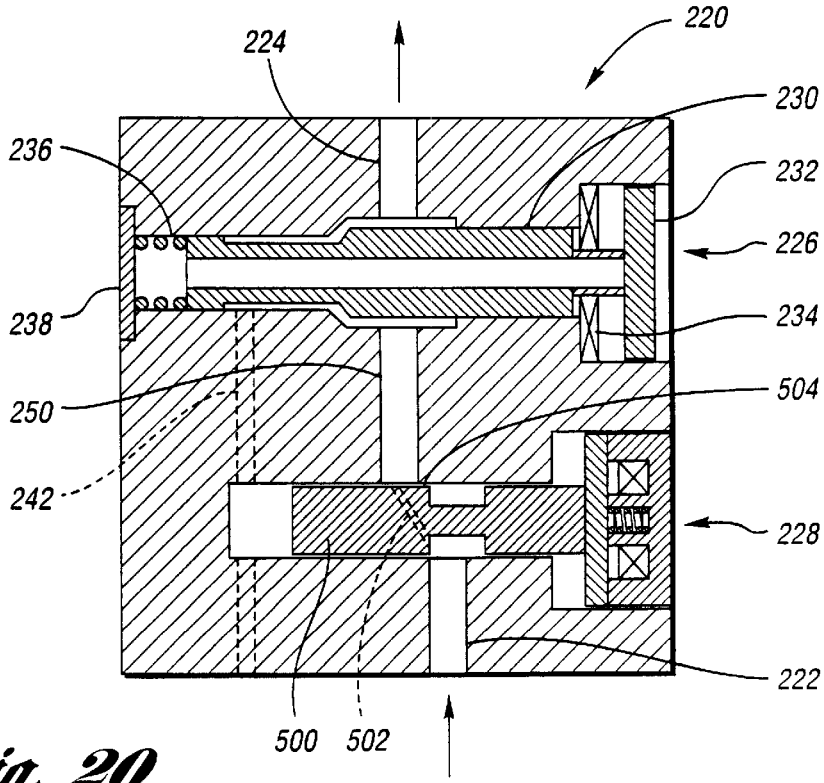
FIG. 20 is a preferred value arrangement for use in pumps and injectors of the present invention.

As mentioned previously, there are many implementations for the control valve and the valve and restriction arrangement and the implementation illustrated in FIGS. 3 and 4 is provided to help facilitate an understanding of the present invention. Specifically, FIGS. 5–8 illustrate the various relative positions of the two valves during various operations of the pump system in the unit pump or the unit injector. Further, the preferred arrangement for the valves is shown in FIG. 20, where a spool valve forms the valve and restriction arrangement.

Figure 5:
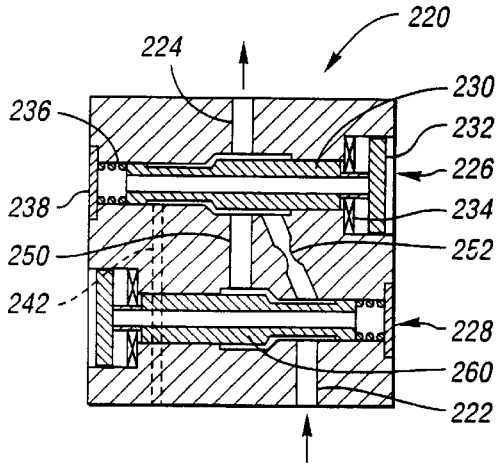
FIGS. 5–8 are enlarged views of the control valve and the valve and restriction arrangement in an exemplary embodiment of the present invention, showing the valve bodies in various operational positions.

In FIG. 5, an exemplary implementation of the high pressure restriction concept for pump systems is generally indicated at 220. Passage 222 receives pressurized fuel from the pumping chamber, while passage 224 directs fuel to the pump system outlet, which may be the outlet of a unit pump or the needle chamber of a unit injector. The control valve is generally indicated at 226, while the valve and restriction arrangement is generally indicated at 228. First valve body 230 is secured to armature 232, and may be closed by actuating solenoid 234. Spring 236 abuts spring seat 238 and urges valve body 230 to the open position, as shown. Valve and restriction arrangement 228 includes second valve body 260, which is shown in the open position. A high pressure restriction 252 allows a pressure differential to develop between the two valves. Path 250 allows fuel to bypass the restriction when valve body 260 is in the open position, as shown.

Figure 6:
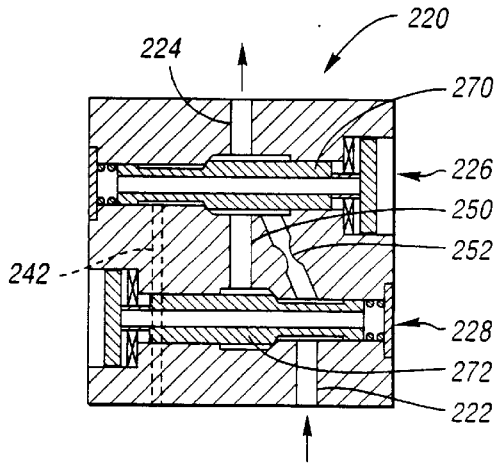
Figure 7:
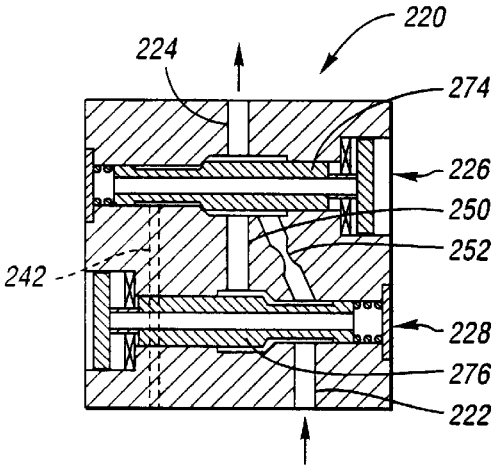
Figure 8:
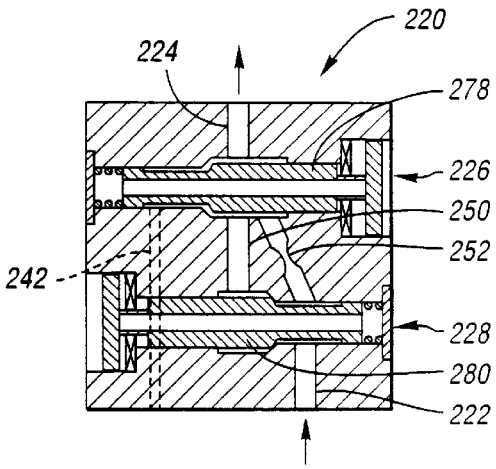

In FIGS. 6–8, like reference numerals are used to indicate like parts from FIG. 5. Specifically, FIG. 6 illustrates the control valve in the closed position at 270, and the valve for controlling the restriction in the closed position at 272. That is, in FIG. 6, pressure builds at the outlet, pressure builds at the pumping chamber, and restriction 252 allows the pressure differential to develop between the two valves.

In FIG. 7, the control valve is closed at 274, while valve 276 is open to allow fuel flow from pumping chamber to bypass the restriction. In FIG. 8, the control valve is open at 278, while the valve 280 is closed, allowing pressure to build in the pumping chamber while relieving pressure at the outlet.

In FIG. 20, a preferred valve arrangement is illustrated. Because many components shown in FIG. 20 are similar to the components shown in FIGS. 5–8, like reference numerals have been used. Specifically, the valve and restriction arrangement of FIG. 20 is a true spool type valve 500, shown with the solenoid energized, pulling spool valve 500 to the right side of FIG. 20 and restricting fuel flow with restriction passage 502. When the solenoid is de-energized, spool valve body 500 moves to the left so that fuel flow past spool valve 500 is unrestricted. It is appreciated that the restriction may be a small diameter passage, as illustrated, or in the alternative, the restriction may be determined by the class of fit and/or the overlap of spool valve 500 and the surrounding pump body. That is, the restriction could be affected at area 504.

The remaining figures, with the exception of FIG. 20, illustrate the operation of the high pressure restriction concept in a pump system of the present invention for various injection control strategies. FIGS. 9–13 illustrate utilizing the high pressure restriction concept of the present invention for performing a boot injection. It is appreciated that parameters such as cam velocity, plunger diameter, and plunger cavity volume may be optimized for boot injection, square injection, post injection, or any other type of injection desired to be performed in accordance with the high pressure restriction concept, and that the various values for the parameters may present trade offs between the different types of injections. In the following description, the term control valve means the valve that controls the bypass to the low pressure reservoir (valve 20 in FIG. 1, valve 38 in FIG. 2). Further, the term restriction valve means the valve that controls fuel flow through the high pressure restriction (valve 18 in FIG. 1, valve 36 in FIG. 2). Even further, the remaining figures illustrate various injection control strategies when the control valve is located between the restriction valve and the outlet. In the alternative, some strategies (such as boot injection or other reduced rate injections) may be performed with the control valve between the restriction valve and the pumping chamber. Even further, valve area means the cross-sectional area allowed for fluid flow through a valve.

Figure 9:
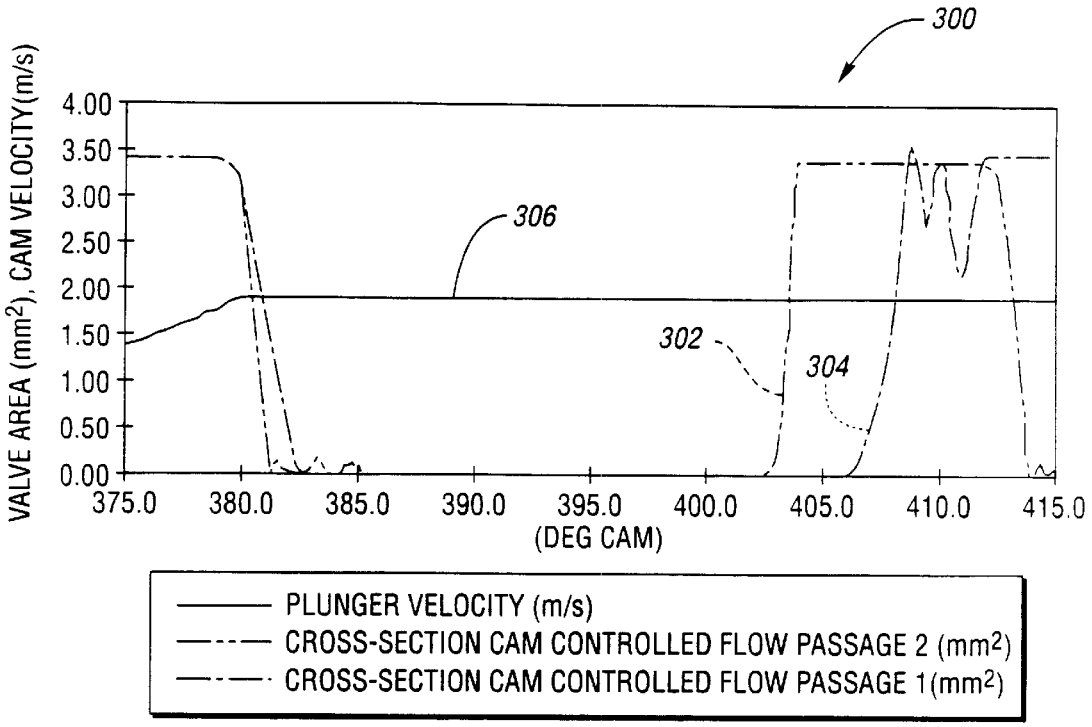
FIG. 9 is a graph depicting valve areas during a boot injection.

In FIG. 9, valve area versus cam degrees is indicated at 300. Plot 302 indicates effective valve area for the restriction valve, while plot 304 indicates effective valve area for the control valve. Plot 306 indicates cam velocity. It is appreciated that FIG. 9 and the remaining figures illustrate operation of the embodiment shown in FIG. 1 (when the restriction valve area is shown as effectively 0, fuel flows through the restriction 16 preferably having an area that is optimized for the particular injection strategies being implemented). In FIG. 9, the restriction valve is closed to throttle fuel flow through the restriction, causing energy to be stored in the plunger cavity. Then, the control valve is closed for boot injection to begin. Opening the restriction valve releases the stored energy causing high pressure injection.

Figure 10:
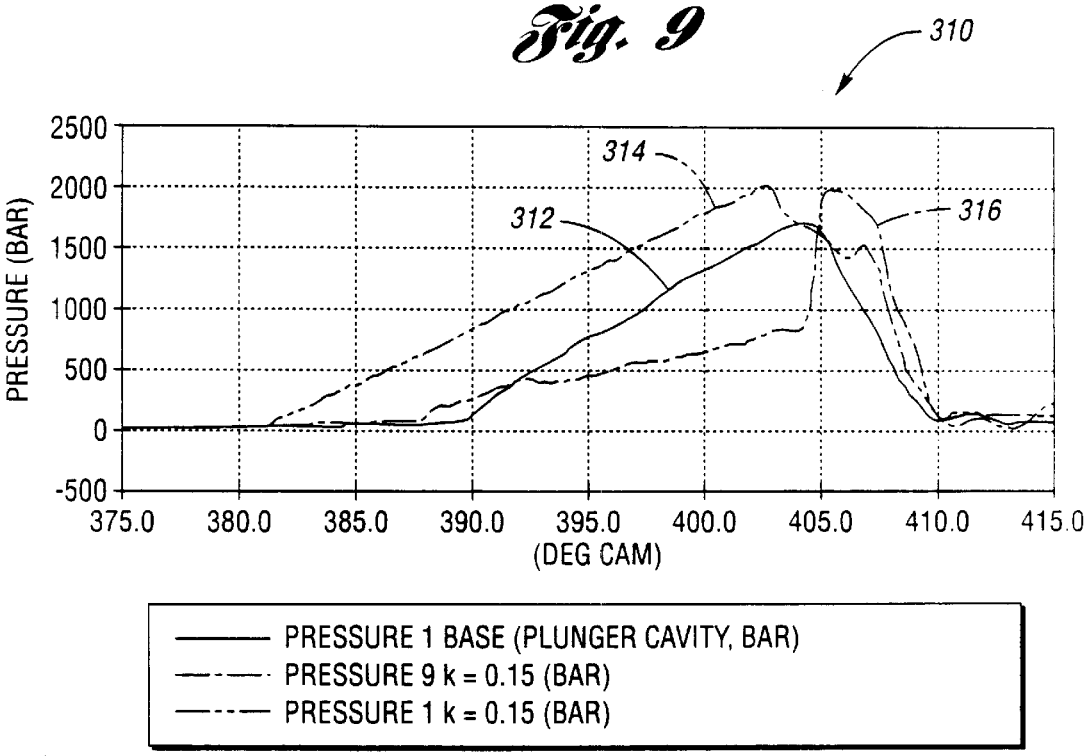
FIG. 10 is a graph depicting pressure versus cam degrees during a boot injection.

In FIG. 10, pressure versus cam degrees is generally indicated at 310 for a boot injection performed at 900 rpm (engine speed). Pumping chamber pressure is indicated at plot 314, while pressure at the needle is indicated at 316. For reference purposes, pumping chamber plot 312 indicates pumping chamber pressure in a standard pump (without the high pressure restriction). As shown, pumping chamber pressure 314 steadily increases, and nozzle needle pressure dramatically increases just after the restriction valve is opened.

Figure 11:
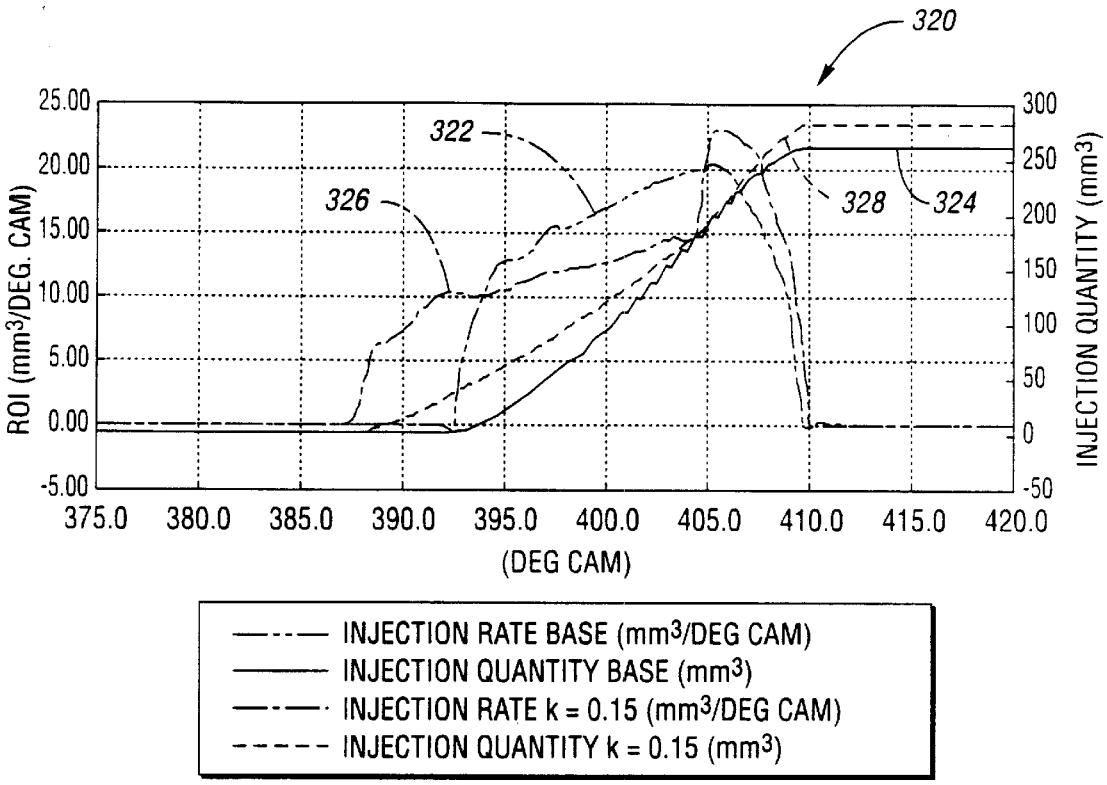
FIG. 11 is a graph depicting fuel delivery versus cam degrees during a boot injection.

In FIG. 11, fuel delivery is generally indicated at 320, and corresponds to the pressure plots of FIG. 10. Injection rate is indicated at plot 326, while injection quantity is indicated at plot 328. For reference purposes, injection rate 322 and injection quantity 324 for a base implementation (without the restriction) are also shown.

Figure 12:
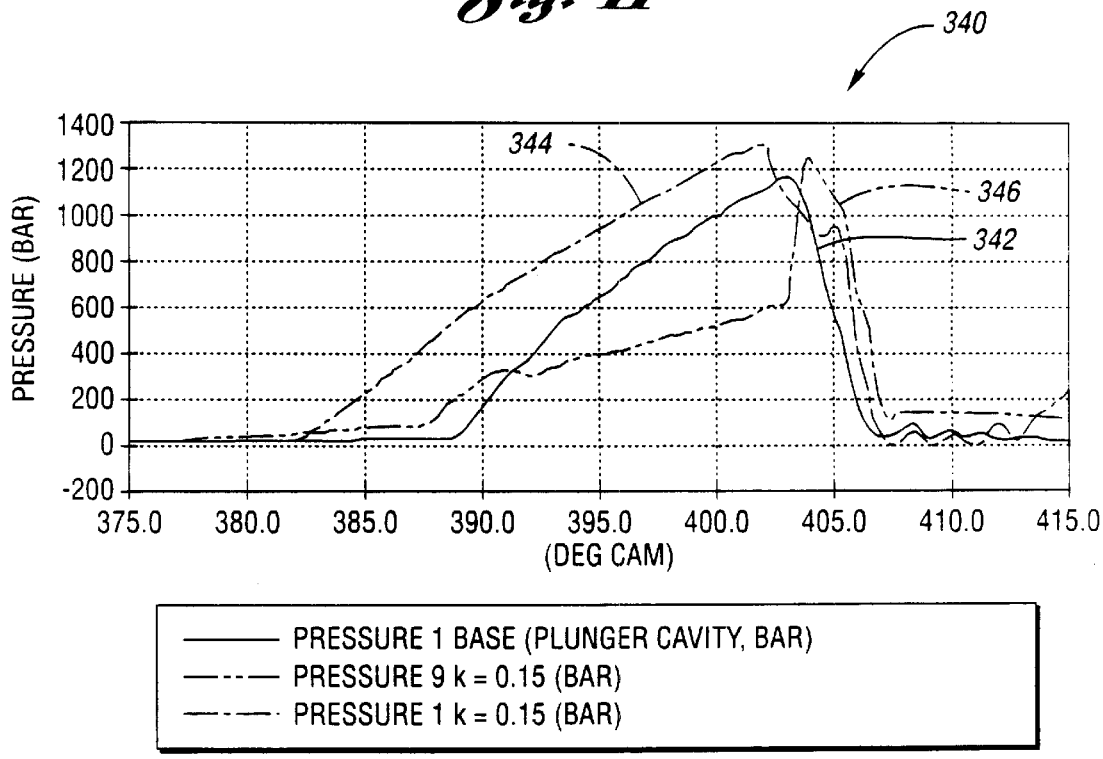
FIG. 12 is a graph depicting pressure versus cam degrees during a boot injection.

In FIG. 12, pump pressure versus cam degrees is generally indicated at 340 for a boot injection at 600 rpm (engine speed). Plot 344 is the pumping chamber pressure, while plot 346 is the needle chamber pressure. For reference purposes, plot 342 illustrates pumping chamber pressure without the high pressure restriction.

Figure 13:
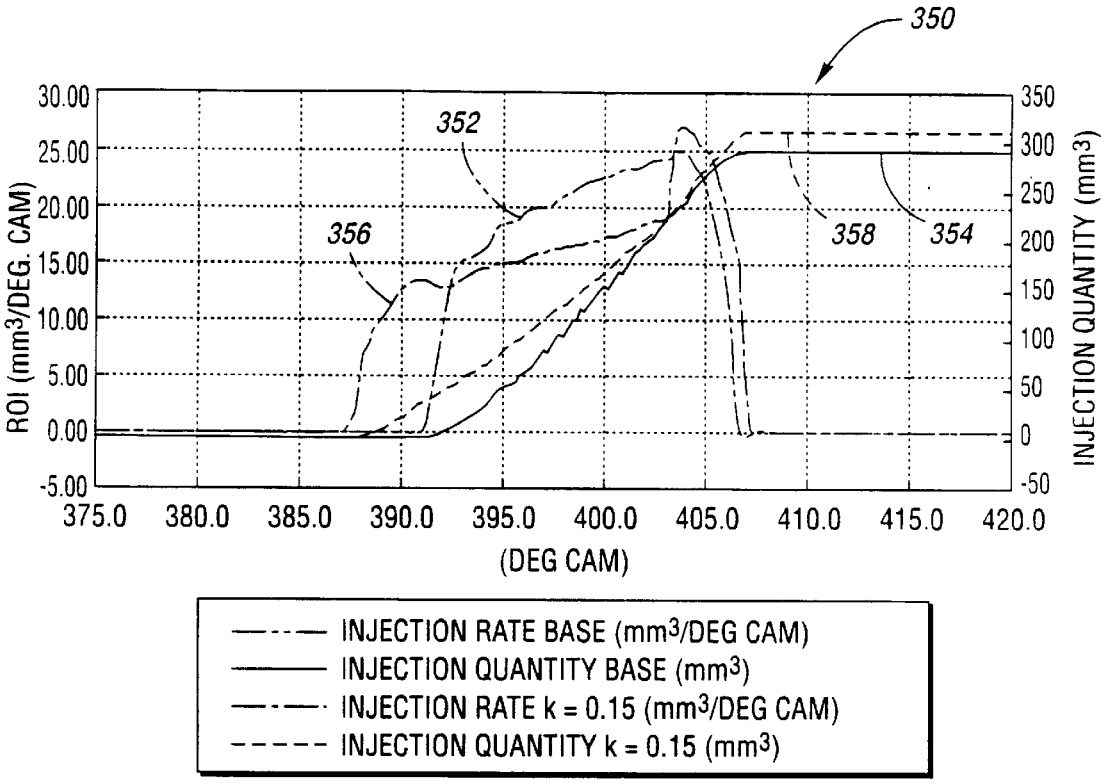
FIG. 13 is a graph depicting fuel delivery versus cam degrees during a boot injection.

In FIG. 13, fuel delivery versus cam degrees is generally indicated at 350, and corresponds to the pressure plots of FIG. 12. Injection rate is indicated at plot 356 while injection quantity is indicated at plot 358. For reference purposes, base injection rate plot 352 and base injection quantity plot 354 (no high pressure restriction) are also provided.

Figure 14:
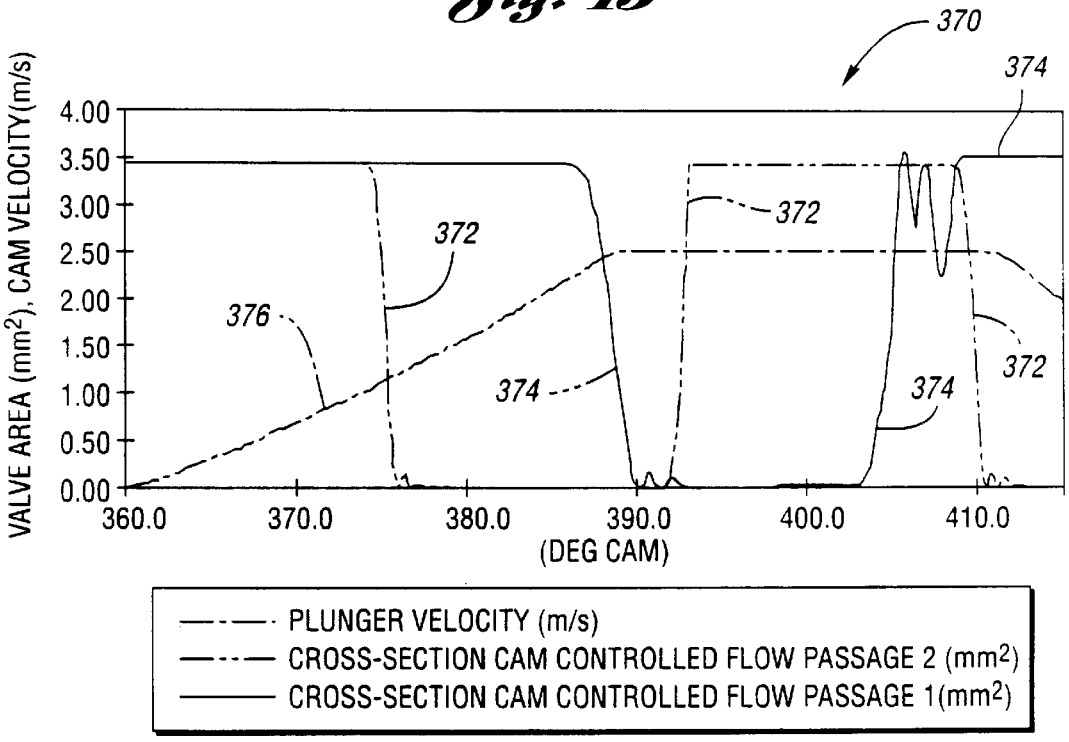
FIG. 14 is a graph depicting valve areas during a square injection.
Figure 15:
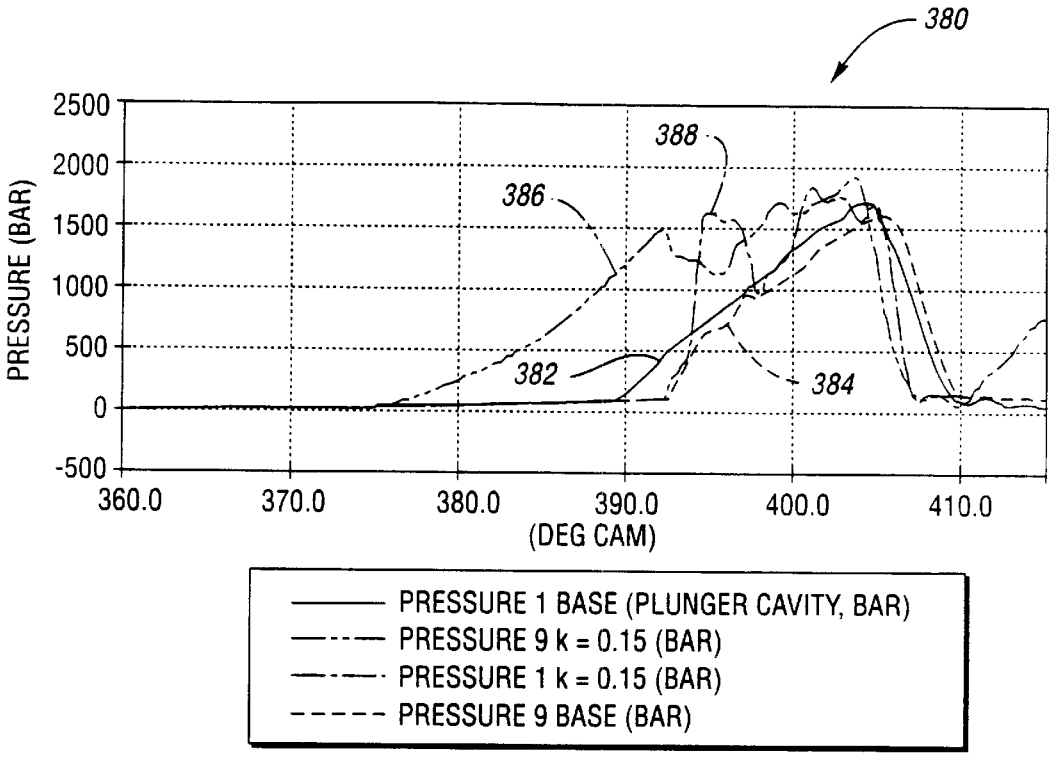
FIG. 15 is a graph depicting pressure versus cam degrees during a square injection.
Figure 16:
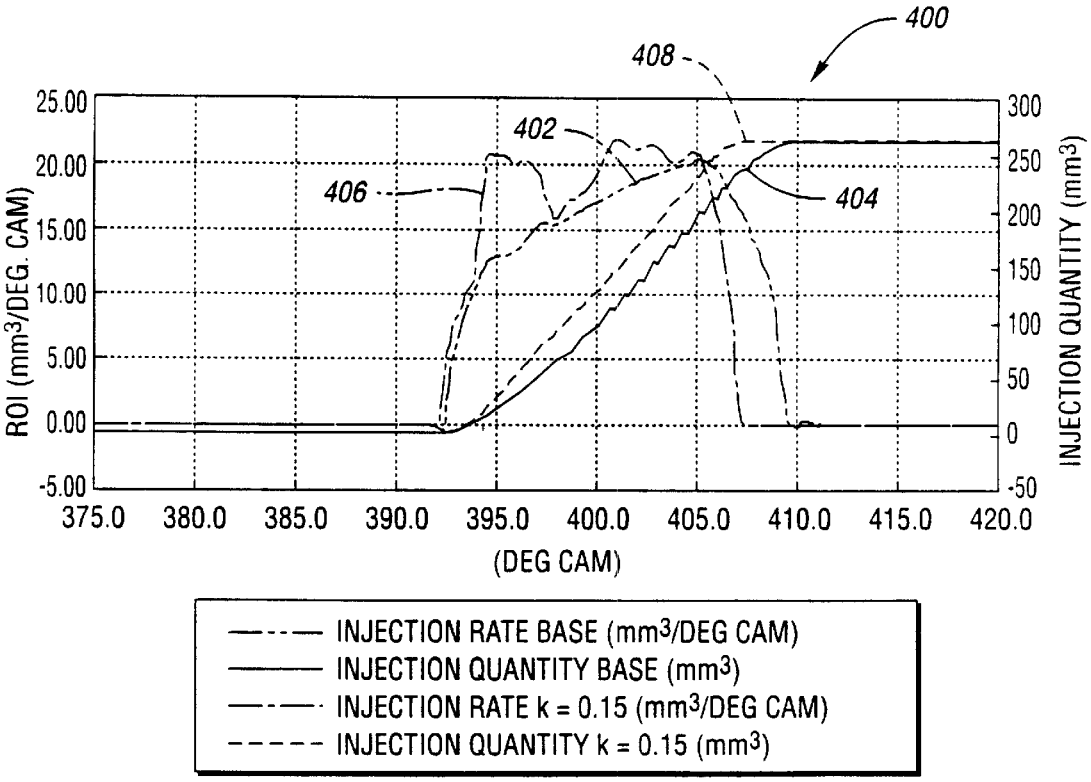
FIG. 16 is a graph depicting fuel delivery versus cam degrees during a square injection.

FIGS. 14–16 illustrate performance of a square injection. In FIG. 14, valve area versus cam degrees is generally indicated at 370. The control valve is indicated at 374 while the restriction valve is indicated at 372. Plunger velocity is indicated at 376. As shown, the restriction valve is closed to store pressure in the pumping chamber. The control valve is closed and the restriction valve is opened at nearly the same time to cause a high initial rate of injection at just past 390 degrees.

In FIG. 15, pump pressure versus cam degrees for square injection at approximately 900 rpm (engine speed) is indicated at 380. Pumping chamber pressure is indicated at 386, while needle chamber pressure is indicated at 388. Base (without the high pressure restriction) pumping chamber pressure plot 382 and needle chamber pressure plot 384 are provided for reference purposes.

In FIG. 16, square injection at 900 rpm is illustrated at 400. Injection rate plot 406 and injection quantity plot 408 illustrate the utilization of a high pressure restriction concept for performing the square injection. For reference purposes, base injection rate plot 402 and base injection quantity plot 404 are provided (no restriction).

Figure 17:
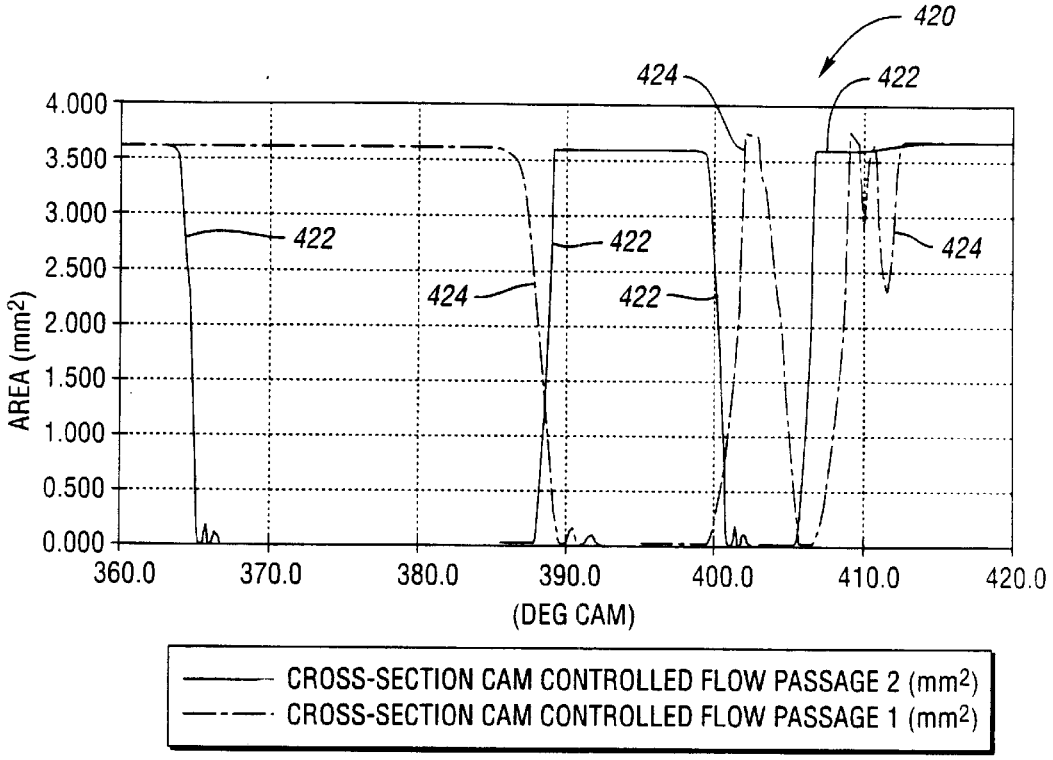
FIG. 17 is a graph depicting valve area versus cam degrees during a post injection.

In FIG. 17, valve are versus cam degrees for a post injection is generally indicated at 420. Valve area for the restriction valve is indicated at plot 422, while valve area for the control valve is indicated at plot 424. As shown, at about 390 degrees, the control valve is closed and the restriction valve is open for a main injection, while at about 400 degrees, the restriction valve is closed and the control valve is open to end the main injection. Then, the control valve is re-closed for a post injection, and the restriction valve is open to release the pressure stored in the pumping chamber. Thereafter, the control valve is then opened to end the post injection.

Figure 18:
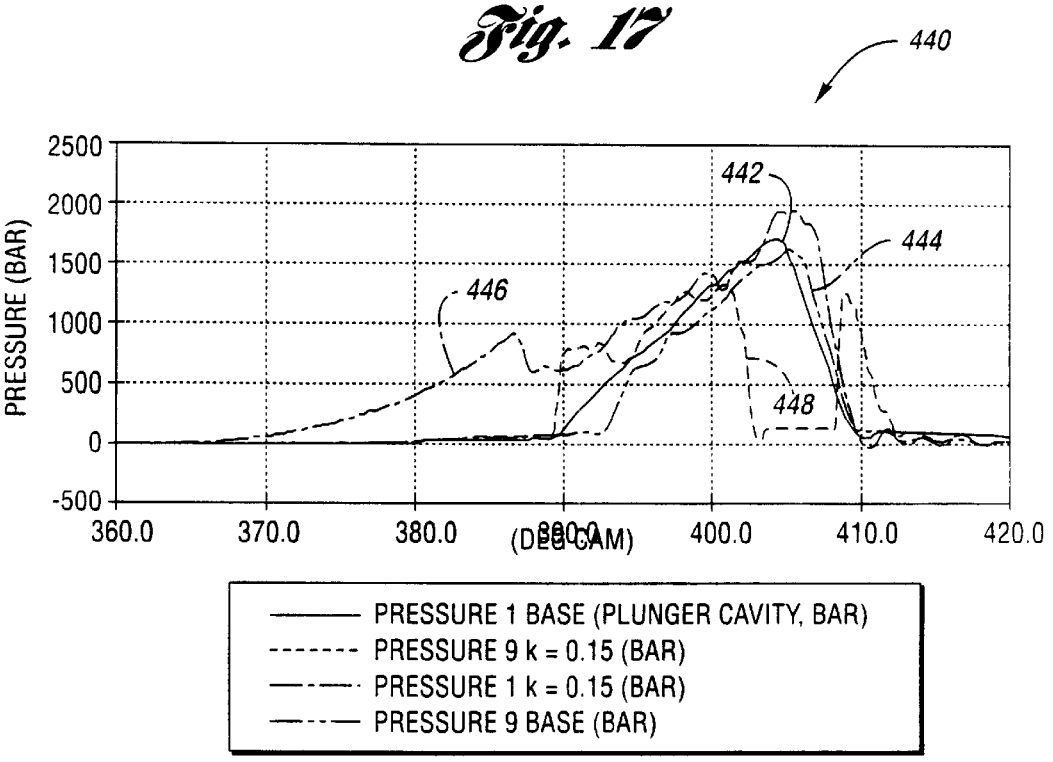
FIG. 18 is a graph depicting pressure versus cam degrees during a post injection.

In FIG. 18, pressure versus degrees for a post injection at about 900 rpm (engine speed) is indicated at 440. Pumping chamber pressure is indicated at plot 446, while needle chamber pressure is indicated at plot 448. As shown by plot 448, a main injection is followed by a post injection. Baseline pumping chamber pressure plot 442 and needle chamber pressure plot 444 are provided for reference purposes (no restriction).

Figure 19:
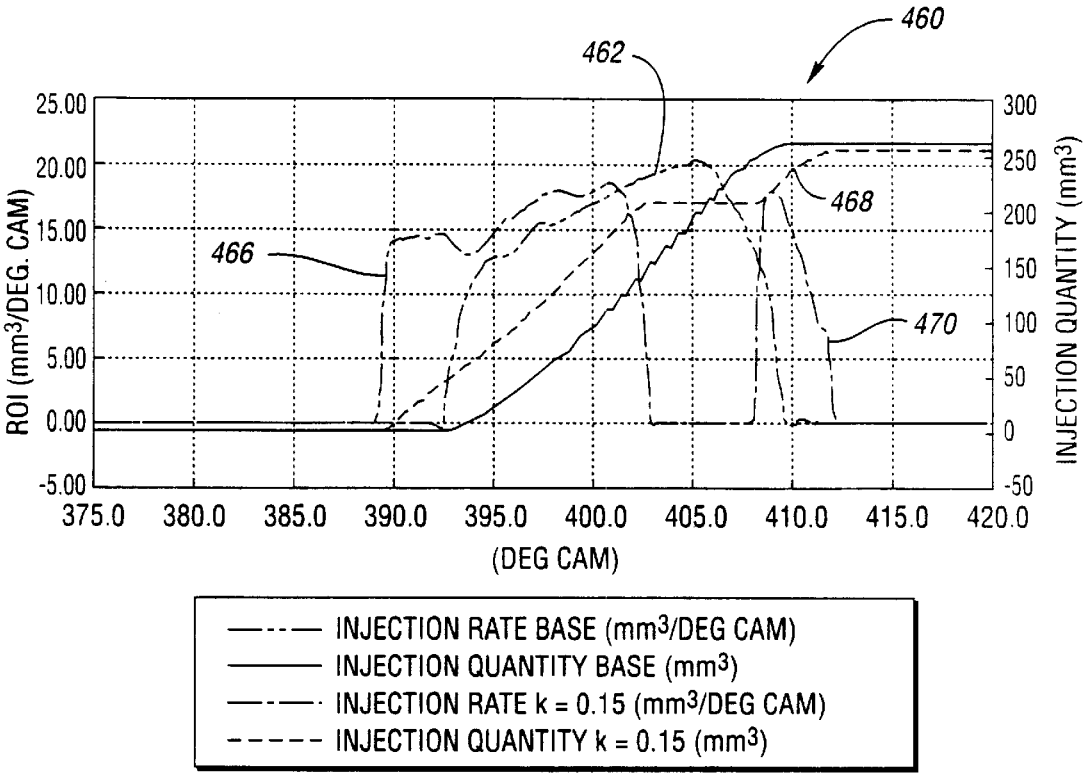
FIG. 19 is a graph depicting fuel delivery versus cam degrees during a post injection.

In FIG. 19, fuel delivery for post injection at 900 rpm is generally indicated at 460. Plot 466 illustrates injection rate, while plot 468 illustrates injection quantity. Portion 470 of plot 466 illustrates injection rate for the post injection. Base injection rate plot 462 and injection quantity plot 464 (without the high pressure restriction concept) are provided for reference purposes).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pump system for a fuel injection system, the pump system comprising:

a body defining a high pressure pumping chamber;

a plunger disposed in the pumping chamber for pressurizing fuel;

an outlet;

a fluid line connecting the pumping chamber to the outlet;

a control valve along the fluid line, the control valve including a first valve body movable between a closed position in which pressurized fuel is routed from pumping chamber to the outlet and an open position in which pressure relief is provided to the fluid line; and a valve and restriction arrangement along the fluid line, including a restriction and a second valve body, the second valve body being movable between an open position in which fuel flow from the pumping chamber is generally unrestricted by the restriction and a closed position in which fuel flow from the pumping chamber is significantly restricted by the restriction to store energy in the pumping chamber.

2. The system of claim 1 wherein the body is a unit pump body.

3. The system of claim 1 wherein the body is a unit injector body and defines a needle chamber, the pump further comprising:

an injector nozzle assembly in flow communication with the high pressure outlet, the assembly including a needle received in the needle chamber, the needle chamber receiving pressurized fuel from the pump outlet.

4. The system of claim 1 wherein the second valve body operates as a pressure-balanced valve.

5. The system of claim 4 wherein the second valve body open position provides a flow cross-sectional area, not including any effective flow cross-sectional area of the restriction, of about two to three millimeters squared.

6. The system of claim 1 wherein the second valve body is configured as a pressure-balanced valve utilizing a through passage as the restriction.

7. The system of claim 1 wherein the valve and restriction arrangement is located between the pumping chamber and the control valve.

8. The system of claim 1 wherein the valve and restriction arrangement is located between the control valve and the outlet.

9. A method of controlling a pump system for a fuel injection system, the pump system having a body defining a pumping chamber, a plunger disposed in the pumping chamber for pressurizing fuel, an outlet, a fluid line connecting the pumping chamber to the outlet, and a control valve along the fluid line, the control valve including a first valve body movable between a closed position in which pressurized fuel is routed from the pumping chamber to the outlet and an open position in which pressure relief is provided to the fluid line, the method comprising:

controlling a valve and restriction arrangement along the fluid line, including a restriction and a second valve body, the second valve body being movable between an open position in which fuel flow from the pumping chamber is generally unrestricted by the restriction and closed position in which fuel flow from the pumping chamber is significantly restricted by the restriction to store energy in the pumping chamber, the valve and restriction arrangement being controlled so as to control fuel flow from the pumping chamber to the outlet.

10. The method of claim 9 further comprising:

closing the control valve for an injection by moving the first valve body to the closed position; and restricting fuel flow from the pumping chamber by moving the second valve body to the closed position to reduce an injection rate, while the control valve is closed.

11. The method of claim 9 further comprising:

closing the control valve for an injection by moving the first valve body to the closed position;

restricting fuel flow from the pumping chamber by moving the second valve body to the closed position to reduce an injection rate, while the control valve is closed; and thereafter, opening the control valve by moving the first valve body to the open position.

12. The method of claim 9 further comprising:

closing the control valve for an injection by moving the first valve body to the closed position;

restricting fuel flow from the pumping chamber by moving the second valve body to the closed position to reduce an injection rate and store energy in the pumping chamber, while the control valve is closed;

unrestricting fuel flow from the pumping chamber by moving the second valve body to the open position to increase the injection rate, while the control valve is closed; and thereafter, opening the control valve by moving the first valve body to the open position.

13. The method of claim 9 wherein the valve restriction arrangement is located between the pumping chamber and the control valve and wherein the method further comprises:

opening the control valve by moving the first valve body to the open position;

restricting fuel flow from the pumping chamber by moving the second valve body to the closed position to store energy in the pumping chamber, while the control valve is open;

thereafter, closing the control valve by moving the first valve body to the closed position; and unrestricting fuel flow from the pumping chamber by moving the second valve body to the open position to increase the injection rate, while the control valve is closed.

14. The method of claim 9 wherein the valve restriction arrangement is located between the pumping chamber and the control valve and wherein the method further comprises:

closing the control valve by moving the first valve body to the closed position;

unrestricting fuel flow from the pumping chamber by moving the second valve body to the open position, while the control valve is closed; and thereafter, opening the control valve by moving the first valve body to the open position; and restricting fuel flow from the pumping chamber by moving the second valve body to the closed position to reduce pressure release at the plunger, while the control valve is open.

15. The method of claim 14 further comprising:

thereafter, closing the control valve by moving the first valve body to the closed position.

16. The method of claim 15 further comprising:

thereafter, unrestricting fuel flow from the pumping chamber by moving the second valve body to the open position to increase an injection rate, while the control valve is closed.

* * * * *

UNITED STATES PATENT AND TRADEMARK OFFICE

CERTIFICATE OF CORRECTION

PATENT NO. : 6,450,778 B1 
DATED : September 17, 2002
INVENTOR(S) : Gregg R. Spoolstra et al.

It is certified that error appears in the above-identified patent and that said Letters Patent is hereby corrected as shown below:

Column 9,
Lines 50-51, replace “from pumping” with -- from the pumping --.

Column 10,
Lines 33-34, replace “and closed position” with -- and a closed position --.

Signed and Sealed this

Fourth Day of March, 2003

JAMES E. ROGAN
*Director of the United States Patent and Trademark Office*